US007082206B2

(12) United States Patent
Mahoney et al.

(10) Patent No.: US 7,082,206 B2
(45) Date of Patent: Jul. 25, 2006

(54) FLEXIBLE HEARING AID TIP WITH AN INTEGRAL RECEIVER

(75) Inventors: Derek D. Mahoney, Manalapan, NJ (US); John M. Margicin, Langhorne, PA (US); Frederick J. Fritz, Skillman, NJ (US); Walter P. Sjursen, Washington Crossing, PA (US)

(73) Assignee: Sarnoff Corporation, Princeton, NJ (US)

( * ) Notice: Subject to any disclaimer, the term of this patent is extended or adjusted under 35 U.S.C. 154(b) by 482 days.

(21) Appl. No.: 09/804,981

(22) Filed: Mar. 13, 2001

(65) Prior Publication Data

US 2002/0006209 A1 Jan. 17, 2002

Related U.S. Application Data

(60) Provisional application No. 60/188,736, filed on Mar. 13, 2000.

(51) Int. Cl.
*H04R 25/00* (2006.01)

(52) U.S. Cl. ..... 381/328; 381/325; 381/322

(58) Field of Classification Search ..... 381/322, 381/324, 325, 326, 327, 328, 330, 309, 380, 381/381, 382; 181/129, 130, 135

See application file for complete search history.

(56) References Cited

U.S. PATENT DOCUMENTS

| | | | | |
|---|---|---|---|---|
| 4,739,512 | A | 4/1988 | Hartl et al. | 381/68 |
| 5,606,621 | A | 2/1997 | Reiter et al. | |
| 5,701,348 | A | 12/1997 | Shennib et al. | 381/68 |
| 5,887,070 | A | 3/1999 | Iseberg et al. | |

FOREIGN PATENT DOCUMENTS

| | | |
|---|---|---|
| WO | WO 99/07182 | 2/1999 |
| WO | WO 03/015463 A2 | 2/2003 |

*Primary Examiner*—Huyen Le
(74) *Attorney, Agent, or Firm*—Hamilton, Brook, Smith & Reynolds, P.C.

(57) ABSTRACT

A flexible tip for a hearing aid includes a mushroom shaped tip, an inner portion having a bore and a receiver mounted within the bore. The receiver can be housing and sealed within a receiver housing. The receiver housing can include a spring having a high compliance along a longitudinal axis and transverse axis, to provide flexibility in the flexible tip. The spring can also having a high stiffness along a radial direction about the circumference of the spring to provide support of the flexible tip from radially directed loads.

20 Claims, 8 Drawing Sheets

FLEXIBLE HEARING AID TIP WITH AN INTEGRAL RECEIVER

RELATED APPLICATIONS

This application claims the benefit of U.S. Provisional Application No. 60/188,736, filed on Mar. 13, 2000. The entire teachings of the above applications are incorporated herein by reference.

This application is related to copending U.S. application:

| ATTORNEY DOCKET NO. | application Ser. No. | TITLE |
|---|---|---|
| SMI-13459pA | 09/524,666 | Disposable Modular Hearing Aid |
| 2506.1005-001 | 09/524,043 | Mass Produced Hearing Aid With a Limited Set of Acoustical Formats |
| 2506.1013-001 | 09/524,040 | One-Size-Fits-All Uni-Ear Hearing Instrument |
| 2506.2008-001 | 09/524,501 | Hearing Aid |
| 2506.2012-000 | 60/188,997 | Hearing Aid With Flexible Shell |
| 2506.2013-000 | 60/188,996 | Hearing Aid Prescription Selector |
| 2506.2014-000 | 60/188,721 | Through-Hole and Surface Mount Technologies for Highly-Automatable Hearing Aid Receivers |
| 2506.2019-000 | 60/188,857 | Remote Programming and Control Means for a Hearing Aid |

all filed Mar. 13, 2000, the entire teachings of which are incorporated herein by reference.

BACKGROUND OF THE INVENTION

Conventional in-the-ear (ITE), in-the-canal (ITC) and completely-in-the-canal (CIC) hearing aids generally have similar topologies and are differentiated by their respective sizes. ITE hearing aids are generally larger than ITC units which are generally larger than CIC hearing aids. These units typically include a receiver, a microphone, a replaceable battery and amplification electronics contained within a semi-rigid housing. To prevent acoustical feedback, the hearing aids can also include a compliant acoustical sealing element that includes the space between a hearing aid and an ear canal.

Developments in hearing aid technology have included the use of a flexible or compliant tip in a hearing aid. The use of a flexible tip provides an acoustic seal between the hearing aid and a user's ear canal. The flexible tip also allows the hearing aid to mold and conform to the geometry of the user's ear canal. Substantial geometric variability exists among various users' ear canals. Such geometric uniqueness requires custom fitted hearing aids to be made. The custom fit minimizes discomfort in a user when wearing the hearing aid and helps to prevent acoustic leakage from the hearing aid which can produce feedback.

Use of the flexible tip in conjunction with a hearing aid provides relatively deep fitting of the hearing aid within a user's ear canal. However, with the use of a flexible tip, the electric components of the hearing aid are located within the hearing aid base unit. Typically, a hearing aid with such a construction is formed as an ITC unit because of the size limitations caused by the geometry of the components. The overall size of the hearing aid depends upon the size and placement of these components within the hearing aid unit.

The overall size of the hearing aid depends upon the size and placement of the components within the hearing aid. The receiver generally consumes a significant fraction of the hearing aid's internal space, thereby being a factor in controlling the overall size of the hearing aid. Because the receiver is located within the body or base unit of the hearing aid, away from an eardrum of a user, the receiver requires a relatively large amount of power from the battery of the hearing aid in order to produce sound to travel through the residual air volume formed in the flexible tip and ear canal to the eardrum, with minimal loss.

A need exists for a reduced size hearing aid, such as a CIC hearing aid, that includes a flexible or compliant tip and reduced power requirements for the receiver.

SUMMARY OF THE INVENTION

Locating the receiver within a flexible hearing aid tip of a hearing aid reduces the size of a hearing aid. With such a configuration an ITC hearing aid can be formed as a CIC unit. Also, mounting the receiver within a hearing aid tip reduces the amount of power required by the receiver by positioning the receiver adjacent to a user's eardrum within the user's auditory canal.

In an embodiment of the invention, a flexible tip for a hearing aid includes a mushroom shaped tip, an inner portion defining a bore having a proximal end and a distal end and a receiver mounted within the bore. The proximal end of the bore can be disposed adjacent an eardrum.

The flexible tip can include a sealing layer formed between the receiver and the inner portion. The sealing layer helps to minimize or eliminate the presence of an acoustical feedback path within the flexible tip. The inner portion of the flexible tip can be formed of a first material while the mushroom shaped tip can be formed of a second material, the second material having a greater compliance than the first material. The use of two materials provides stability to the inner portion and compliance to the mushroom shaped tip.

Alternately, the flexible tip includes a tip portion for sealing an ear canal, an inner portion defining a bore having a proximal end and a distal end and a receiver mounted within the bore. The inner portion is formed of a flexible material adapted to conform to the geometry of an ear canal. The proximal end of the bore is adapted to be disposed adjacent an eardrum.

The flexible tip can also include a receiver housing integrally formed with the bore of the flexible tip where the receiver is mounted within the receiver housing. The receiver can be attached to the receiver housing with a sealing layer located between the receiver and the receiver housing. The sealing layer can minimize or eliminate the presence of an acoustical feedback path within the flexible tip.

The flexible tip can also include a receiver housing and spring assembly integrally formed with the bore of the flexible tip where the receiver is mounted within the receiver housing. A sealing layer can be located between the receiver and the receiver housing to help minimizing the presence of an acoustical feedback path. The mushroom shaped tip and the inner portion can be formed of a compliant material.

The spring of the receiver housing and spring assembly can be compliant along a transverse axis and a longitudinal axis to provide flexibility in the tip. The spring can also include a radial stiffness to provide support from radial loads placed on the flexible tip. Furthermore, the spring can include a hearing aid securing portion for securing the flexible tip to a hearing aid.

The flexible tip as described can be mounted within a hearing aid having a microphone, a battery and electronics.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
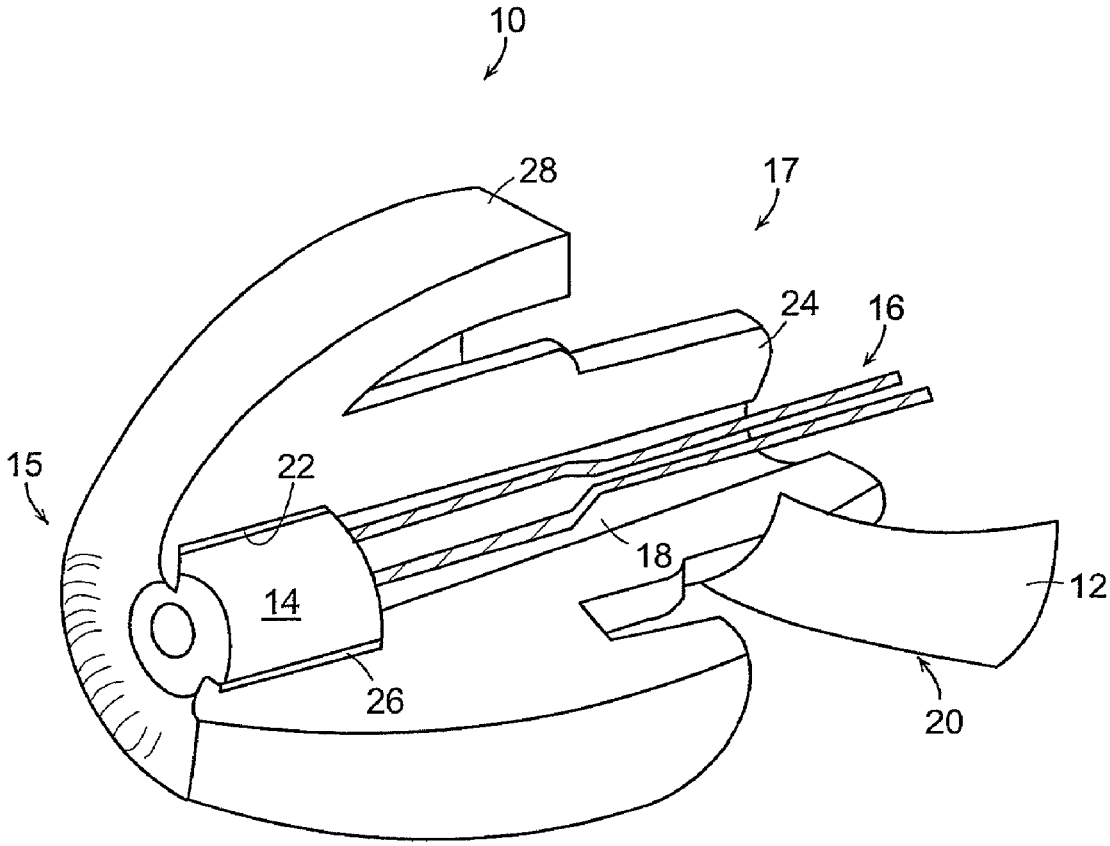
FIG. 1 illustrates a perspective sectional view of a flexible hearing aid tip having a receiver mounted in the proximal end of the tip.

FIG. 1 illustrates an embodiment of a flexible hearing aid tip given generally as 10. The flexible tip 10 includes a proximal end 15 and a distal end 17 and is formed of an inner portion 24 having a bore 18, a tip portion and a receiver 14. Preferably, the tip portion is a mushroom shape tip 28. The tip 10 attaches to a hearing aid 20 having a shell 12. The tip 24 is flexible and conforms to the geometry of a user's ear canal. The mushroom shaped tip 28 creates a seal between the hearing aid 20 and a user's ear canal. This seal minimizes the occurrence of feedback within the hearing aid 20.

In FIG. 1, the receiver 14 is mounted within the bore 18 at the proximal end 15 of the hearing aid tip 10. A sealing layer 26 is located between the receiver 14 and the hearing aid tip 10. The sealing layer 26, which can be an adhesive, secures the receiver 14 to the hearing aid tip 10. The sealing layer 26 eliminates the presence of an internal acoustical feedback path between the bore 18 and the receiver 14. For example, when placing a receiver 14 within the bore 18 of the hearing aid tip 10, a space or gap is formed between the receiver 14 and inner wall 22 of the bore 18. This gap creates an internal acoustic feedback path within the hearing aid 20. During operation, the receiver 14 converts an electric signal into an acoustic signal and transfers the acoustic signal to a user's eardrum. Some acoustic vibrations are reflected from the eardrum and are directed toward the receiver 14. With an acoustic feedback path present in the hearing aid 20, the reflected acoustic vibrations travel through the feedback path to a microphone within the hearing aid 20. The reflected waves are received by the microphone, amplified and sent toward the receiver 14, creating an audio feedback loop within the hearing aid 20. By sealing the receiver 14 to the inner wall 22 of the bore 18, the internal feedback path is minimized or eliminated.

The receiver 14 includes a pair of electrical connectors 16, such as wire. The electrical connectors 16 provide an electrical connection between the receiver 14 and hearing aid electronics. Because the receiver 14 is mounted within the flexible tip 10, the receiver 14 can be placed within relatively close proximity to a user's eardrum, compared to a receiver located within the body of a hearing aid. With the receiver 14 located adjacent to a user's eardrum, the residual volume of air located between the receiver and the eardrum is relatively small. Less power is thus required to drive the air within this residual volume. Because less power is required in the receiver 14 mounted within the flexible tip, the size of the receiver can also be smaller than that of the receiver mounted within the hearing aid body.

The receiver 14 is shown as having a cylindrical shape. It is within the scope of the invention that a receiver having a non-cylindrical shape can be used within the bore 18.

The tip 10 can be formed as a composite from several different rubber materials having different durometer values and compliances. For example, the inner portion 24 can be made from a relatively high durometer and stable material such as a 60 durometer rubber while the mushroom shape tip 28 can be made from a relatively low durometer or compliant material such as a 10 durometer rubber. The high durometer of the inner portion 24 controls the flexibility of the hearing aid tip 10, allowing the hearing aid tip to navigate the S-shaped path of the ear canal, and provides radial stability, thereby preventing the bore 18 from collapsing upon itself when the tip 10 is inserted into an ear canal. Because of its low durometer, the mushroom shape tip 28 provides comfort to a wearer while producing a sufficient acoustic seal within the ear canal of a user. The low durometer material of the mushroom shape tip 28 can be cast molded from PlatSil 71-20 silicone (Polytek Development Corporation, Easton, Pa.), for example. An injection molding process can also be used to form the low durometer portion of tip 10. In the injection molding process the hearing aid tip 10 can be made using elastomeric materials similar to C-flex (Consolidated Polymer Technologies, Inc., Largo, Fla.), Dynaflex (GLS Corporation, Thermoplastic Elastomers Division, McHenry, Ill.) or Q-flex (Flexan, Chicago, Ill.).

Figure 2:
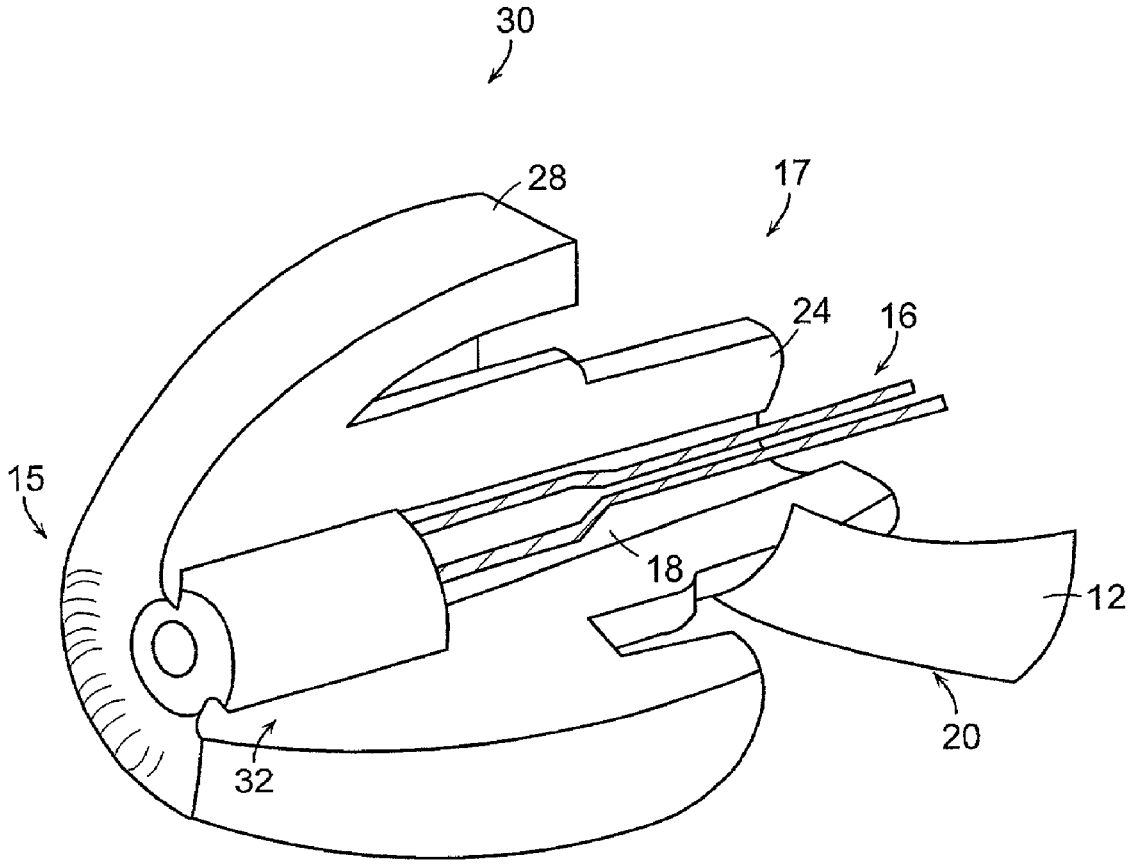
FIG. 2 illustrates a perspective sectional view of a flexible hearing aid tip having a receiver housing assembly mounted in the proximal end of the tip.

FIG. 2 illustrates an alternate embodiment of a hearing aid tip, given generally as 30. A receiver housing assembly 32 is mounted within the hearing aid tip 30. Preferably, the receiver housing assembly 32 is formed of a plastic material and is molded into the hearing aid tip 30. Such molding prevents motion of the receiver housing assembly 32 within the bore 18 of the hearing aid tip 30. The molding also eliminates formation of a potential acoustic feedback path between the housing assembly 32 and bore 18. As described above, the hearing aid tip 30 can be formed different durometer materials. The mushroom shaped tip 28 can be formed of a low durometer material while the inner portion 24 can be formed of a high durometer material. The high durometer material of the inner portion 24 allows flexibility of the hearing aid tip 30 while providing for radial stability, thereby preventing the bore 18 from collapsing when placed in a user's ear canal. The low durometer material of the mushroom shaped tip 28 provides comfort for the user, even when located in a bony region of a user's ear.

Figure 3:
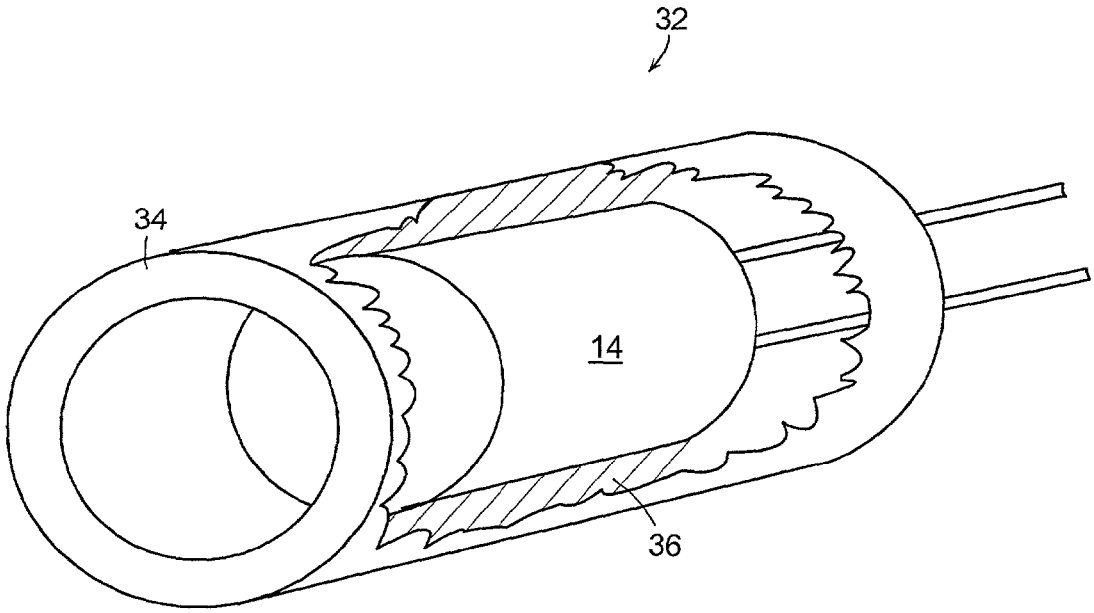
FIG. 3 illustrates a perspective sectional view of a receiver housing assembly.
Figure 4:
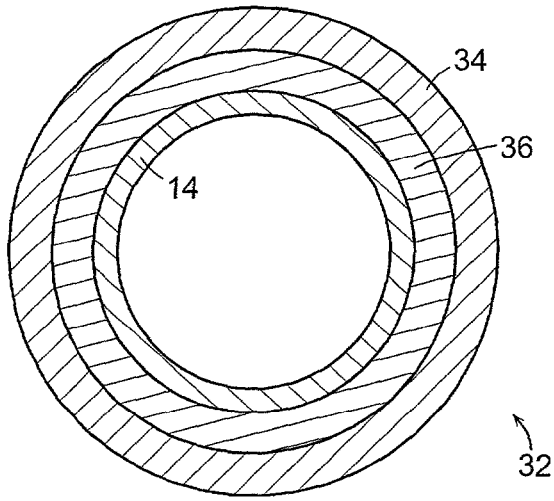
FIG. 4 illustrates a front sectional view of the receiver housing assembly of FIG. 3.

The receiver housing assembly 32 is illustrated in FIGS. 3 and 4 as a perspective and cross-sectional view, respectively. The receiver housing assembly 32 includes a receiver housing or receptacle 34 and a receiver 14. The receiver 14 is attached within the receiver housing 34 by a sealing layer 36. The sealing layer helps to eliminate the presence of an internal acoustical feedback path within the receiver housing 34 in the hearing aid tip 30. The sealing layer 36 can be an adhesive. The sealing layer 36 also secures the receiver 14 within the receptacle 34 and prevents the receiver 14 from moving within the receiver housing 34.

Figure 5:
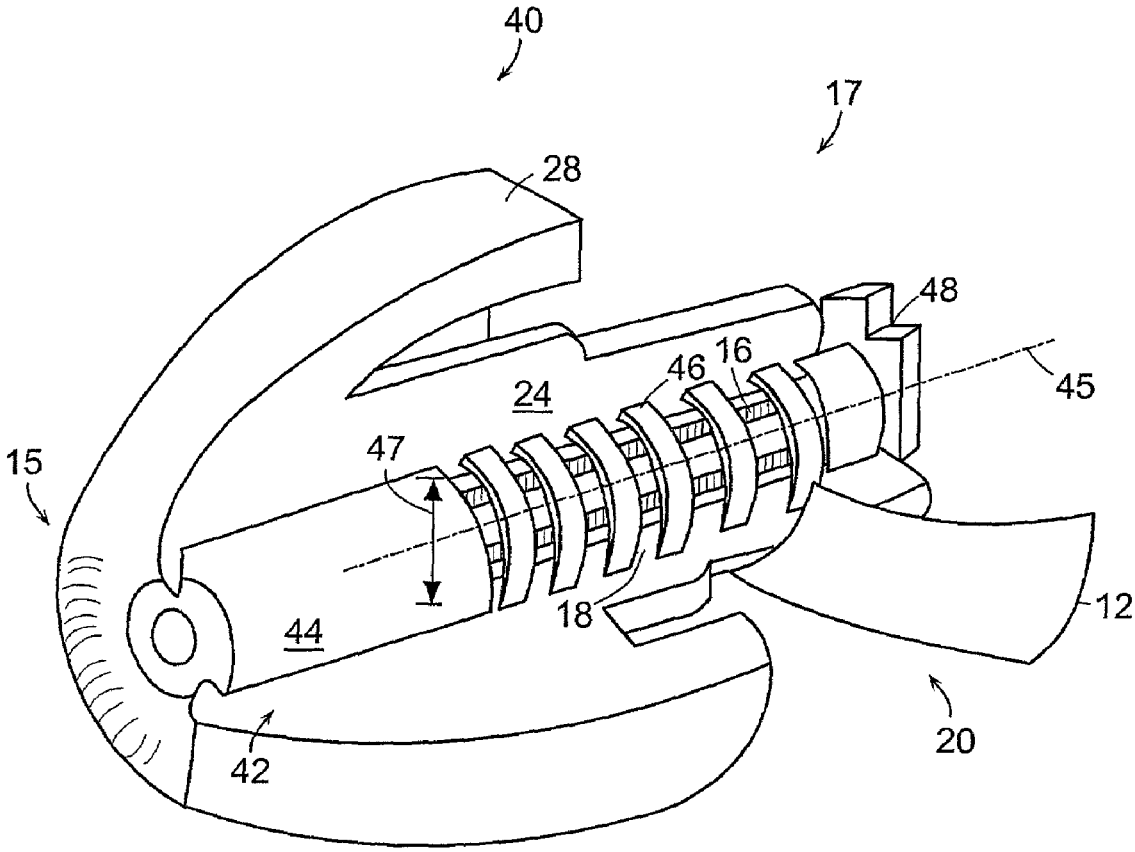
FIG. 5 illustrates a perspective sectional view of a flexible hearing aid tip having a receiver housing and spring assembly.
Figure 6:
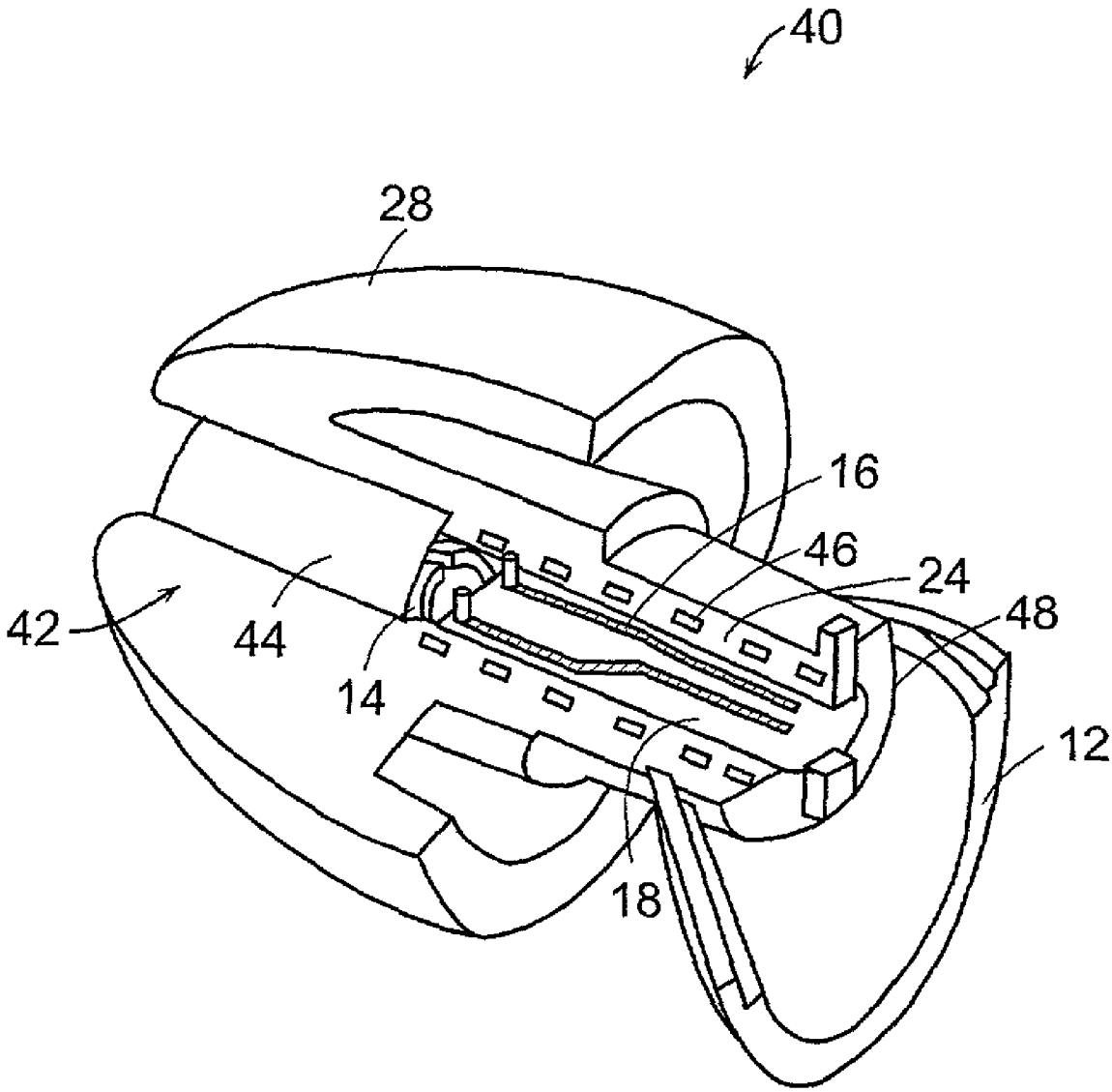
FIG. 6 shows a rear perspective view of the flexible hearing aid tip of FIG. 5.

FIGS. 5 and 6 illustrate another preferred embodiment of a hearing aid tip, given generally as 40. FIG. 5 illustrates a front perspective view while FIG. 6 illustrates a rear perspective view. The hearing aid tip 40 includes a receiver housing and spring assembly 42 that includes a receiver housing or receptacle 44, a spring 46 and a receiver 14. The receiver housing and spring assembly 42 can be molded as a single element, formed by an injection molding process. Preferably, the assembly 42 is formed from a plastic material. The receiver housing 44 encloses a receiver 14, similar as described above. A sealing layer is located between the receiver 14 and the receiver housing 44 to form an acoustic seal. The tip 40 is preferably cast molded from a single, low durometer material such as PlatSil 71-20 silicone. An injection molding process can also be used to form the hearing aid tip 40 from elastomeric materials similar to C-Flex, Dynaflex or Q-flex.

The receiver housing and spring assembly 42 is integrally formed with the flexible tip 40. This integral formation eliminates the presence of an internal feedback path. The spring 46 attached to the receiver housing 44 is molded into the inner portion 24 of the hearing aid tip 40. The spring 46 is highly compliant along its transverse 47 and longitudinal 45 axis. The high compliance of the spring 46 along these axis 45, 47 provides flexibility in the inner portion 24 of the tip 40. The spring 46 facilitates insertion of the tip 40 into a user's ear canal by allowing the tip 10 to navigate the nominally S-shaped center line path of the ear canal. The spring 46 also has a low compliance or high stiffness in a radial direction about its circumference. This radial stiffness provides support from radially directed loads, thereby minimizing the risk of a potential collapse of the bore 18 of the tip 40 during or after insertion into an ear canal.

Figure 7:
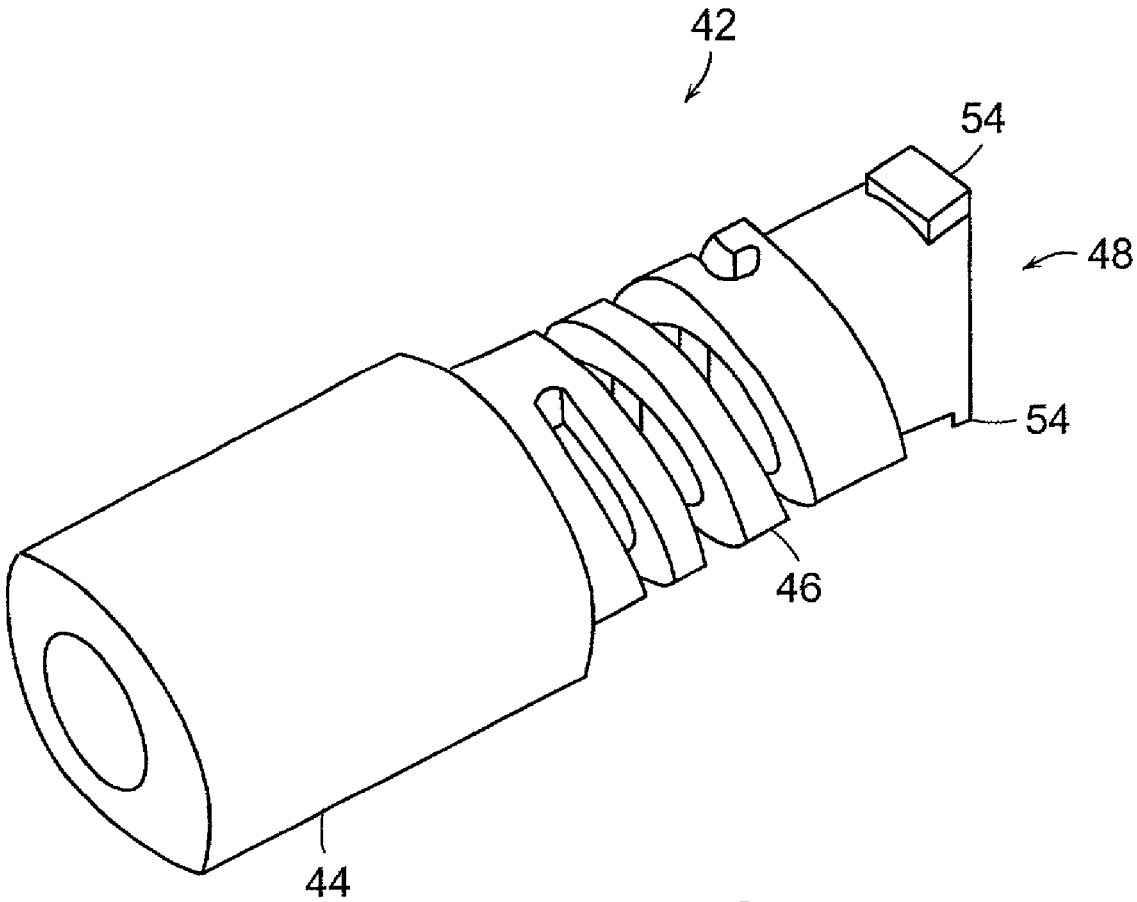
FIG. 7 illustrates a perspective view of a receiver housing and spring assembly.

FIG. 7 illustrates a receiver assembly 42 wherein the spring 46 includes a securing portion 48 having at least one protrusion 54. The securing portion 48 of the receiver assembly 42 prevents the hearing aid tip 40 from being removed from the shell 12 of a hearing aid 20 after assembly.

Figure 8:
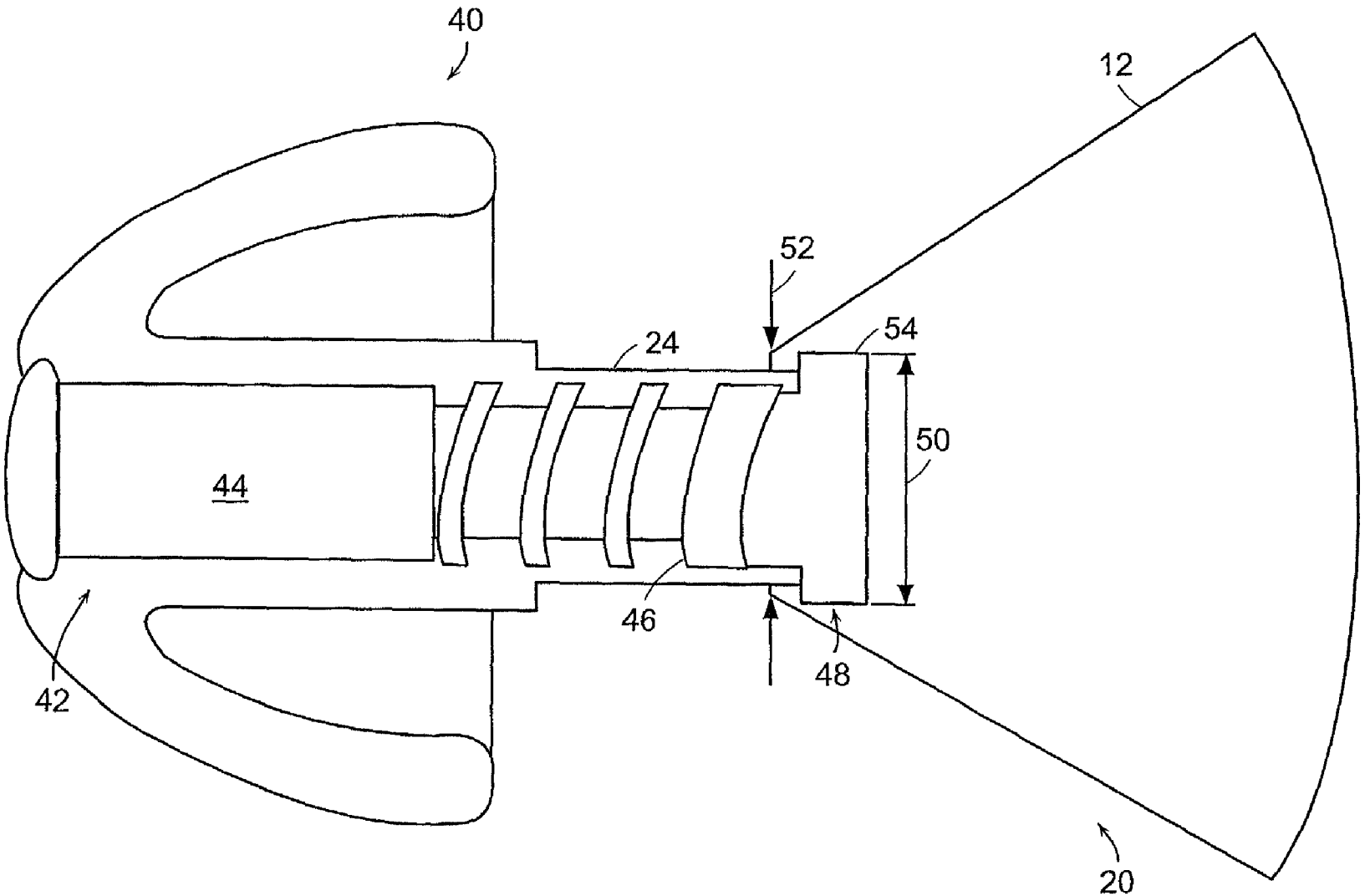
FIG. 8 illustrates a cross-sectional view of a flexible hearing aid tip mounted within a hearing aid body.

FIG. 8 illustrates a sectional view of a hearing aid tip 40 mounted within a hearing aid 20 or shell 12. The securing portion 48 includes at least one protrusion 54 such that the securing portion 48 has a length 50. The shell 12 of the hearing aid 20 has a diameter 52 that is smaller than the length 50 of the securing portion 48. During the assembly of the hearing aid 20, the tip 40 is installed within the shell 12 such that the protrusion 54 is located within the shell 12. A second shell portion is placed over the shell to form a hearing aid body. Because the protrusion 54 is larger than the diameter 52 of the shell 12, the hearing aid tip 40 cannot be removed from the shell 12 after the hearing aid 20 has been assembled.

Figure 9:
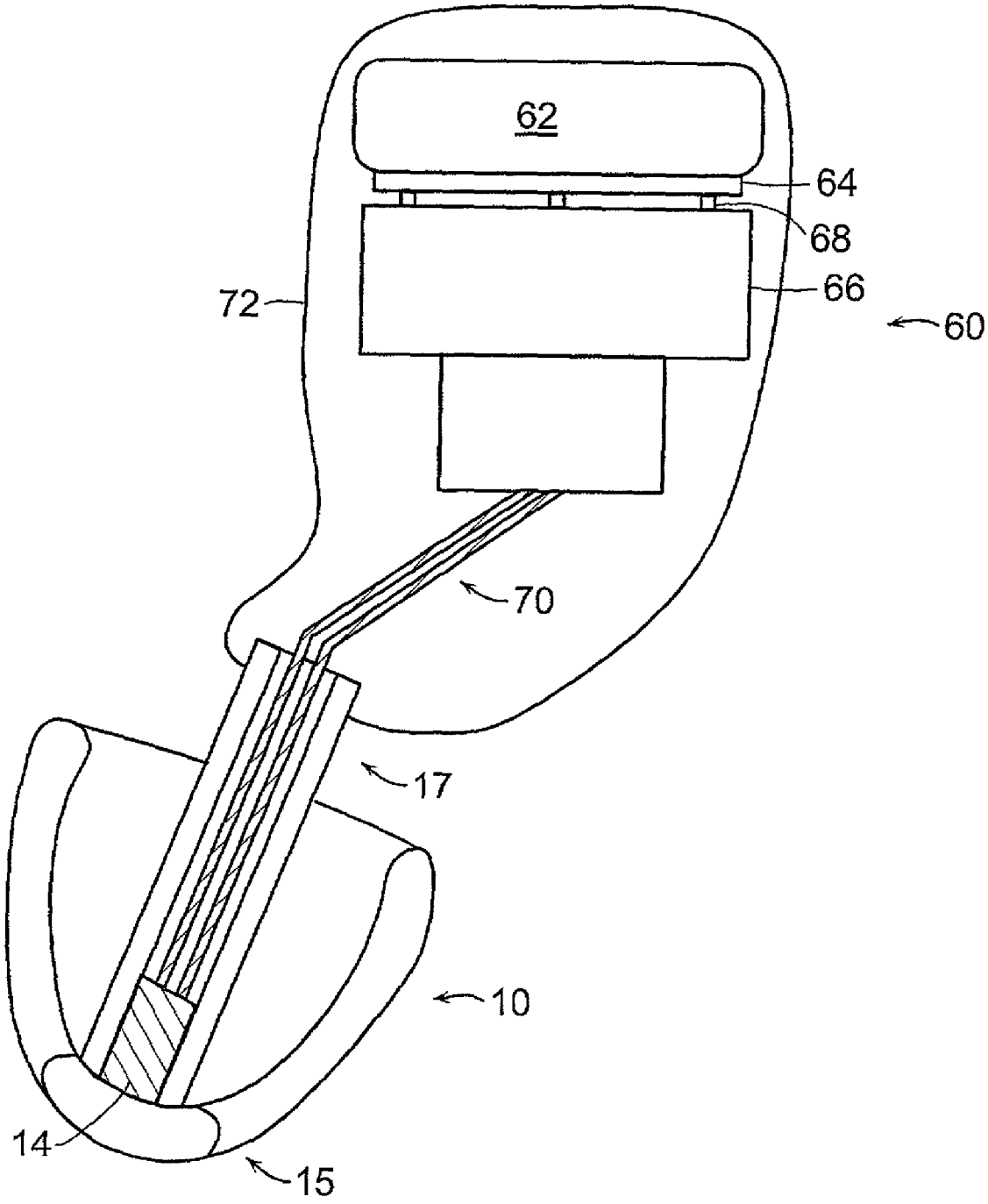
FIG. 9 illustrates a sectional view of a hearing aid with a flexible hearing aid tip.

FIG. 9 illustrates a hearing aid 60 having a hearing aid body 72 and a hearing aid tip 10. While the hearing aid tip is illustrated as having a receiver 14 located in the proximal end 15 of the hearing aid tip 10, other hearing aid tips, as described above, can be used in conjunction with the hearing aid 60. For example, a receiver housing assembly can be located in the proximal end 15 of the hearing aid tip or a receiver housing and spring assembly 42 can also be used. The hearing aid 60 includes a microphone 62, electronics 64, a battery 66, first connector 68 between the battery 66 and the electronics 64 and second connector 70 located between the electronics 64 and the receiver 14. The use of a hearing aid 60 with a flexible tip 10 having a receiver 14 allows the hearing aid to be manufactured having a smaller size. Preferably, such a hearing aid is a CIC hearing aid.

While this invention has been particularly shown and described with references to preferred embodiments thereof, it will be understood by those skilled in the art that various changes in form and details may be made therein without departing from the scope of the invention encompassed by the appended claims.

What is claimed is:

1. A flexible tip for a hearing aid comprising:

an inner portion of the tip defining a bore having a proximal end and a distal end, the proximal end of the bore adapted to be disposed adjacent an eardrum and a housing formed in the tip at the bore, the inner portion being formed of a first material having sufficient flexibility to allow the inner portion to navigate the S-shaped path of an ear canal while maintaining sufficient stability to prevent the bore from collapsing when the tip is inserted into an ear canal;

a receiver mounted within the housing; and a mushroom shaped portion, integral with the inner portion, and extending radially from the proximal end of the inner portion, that creates a seal in the bony portion of an ear canal when the tip is inserted into an ear, the mushroom shaped portion being formed of a second material, the second material having a greater compliance than the first material.

2. The flexible tip of claim 1 further comprising a sealing layer formed between the receiver and the inner portion, the sealing layer minimizing the presence of an acoustical feedback path within the flexible tip.

3. The flexible tip of claim 1 in which the housing is integrally formed within the bore of the flexible tip.

4. The flexible tip of claim 3 further comprising a sealing layer between the receiver and the receiver housing, the sealing layer minimizing the presence of an acoustical feedback path within the flexible tip.

5. The flexible tip of claim 1 further comprising a receiver housing and spring assembly integrally formed with the bore of the flexible tip, the receiver mounted within the receiver housing.

6. The flexible tip of claim 5 wherein the spring is compliant along a transverse axis and a longitudinal axis to provide flexibility in the tip.

7. The flexible tip of claim 5 wherein the spring comprises a radial stiffness to provide support from radial loads placed on the flexible tip.

8. The flexible tip of claim 5 wherein the spring comprises a hearing aid securing portion for securing the flexible tip to a hearing aid.

9. The flexible tip of claim 5 further comprising a sealing layer between the receiver and the receiver housing, the sealing layer minimizing the presence of an acoustical feedback path.

10. A hearing aid comprising:

a hearing aid base unit having a housing, a microphone, a battery and electronics; and a flexible tip connected to the base unit, the flexible tip having a mushroom shaped portion and an inner portion, the inner portion of the tip defining a bore having a proximal end and a distal end, the proximal end adapted to be disposed adjacent an eardrum, and a housing formed in the tip at the bore and a receiver mounted within the housing, the inner portion being formed of a first material having sufficient flexibility to allow the inner portion to navigate the S-shaped path of an ear canal while maintaining sufficient stability to prevent the bore from collapsing when the tip is inserted into an ear canal and the mushroom shaped portion being integral with the inner portion, and extending radially from the proximal end of the inner portion, the mushroom shaped portion creating a seal in the bony portion of an ear canal when the tip is inserted into an ear, the mushroom shaped portion being formed of a second material, the second material having a greater compliance than the first material.

11. The hearing aid of claim 10 further comprising a sealing layer formed between the receiver and the inner portion, the sealing layer minimizing the presence of an acoustical feedback path within the flexible tip.

12. The hearing aid of claim 10 wherein the housing is integrally formed with the bore of the flexible tip.

13. The hearing aid of claim 12 further comprising a sealing layer between the receiver and the receiver housing, the sealing layer minimizing the presence of an acoustical feedback path within the flexible tip.

14. The hearing aid of claim 10 further comprising a receiver housing and spring assembly integrally formed with the bore of the flexible tip, the receiver mounted within the receiver housing.

15. The hearing aid of claim 14 wherein the spring is compliant along a transverse axis and a longitudinal axis to provide flexibility in the tip.

16. The hearing aid of claim 14 wherein the spring comprises a radial stiffness to provide support from radial loads placed on the flexible tip.

17. The hearing aid of claim 14 wherein the spring comprises a hearing aid securing portion for securing the flexible tip to a hearing aid body.

18. The hearing aid of claim 14 further comprising a sealing layer between the receiver and the receiver housing, the sealing layer minimizing the presence of an acoustical feedback path.

19. A method for placing a receiver adjacent to an eardrum comprising:

providing a hearing aid with a flexible tip having an inner portion defining a bore and a mushroom-shaped portion integral with the inner portion, and extending radially from a proximal end of the inner portion, the flexible tip having the receiver mounted within the bore in a housing which is integrally formed in the bore, the inner portion being formed of a first material having sufficient flexibility to allow the inner portion to navigate the S-shaped path of an ear canal while maintaining sufficient stability to prevent the bore from collapsing when the tip is inserted into an ear canal, and the mushroom shaped portion being formed of a second material, the second material having a greater compliance than the first material;

placing the hearing aid within an ear of a user; and placing the flexible tip adjacent to the eardrum within the ear of the user such that the mushroom shaped portion creaties a seal in the bony portion of an ear canal.

20. The method of claim 19 comprising decreasing the amount of power required by the receiver.

* * * * *